United States Patent [19]

Fulton et al.

[11] 4,254,703

[45] Mar. 10, 1981

[54] ARTICLE STRAPPING METHOD AND APPARATUS

[75] Inventors: Edward W. Fulton, Exton, Pa.; Philip J. Pistun, Newark, Del.

[73] Assignee: Cyklop Strapping Corporation, Philadelphia, Pa.

[21] Appl. No.: 132,953

[22] Filed: Mar. 24, 1980

Related U.S. Application Data

[63] Continuation-in-part of Ser. No. 47,556, Jun. 11, 1979, abandoned.

[51] Int. Cl.[3] ..... B65B 13/22

[52] U.S. Cl. ..... 100/2; 100/4; 100/26; 100/32

[58] Field of Search ..... 100/2, 4, 7, 32, 29, 100/30, 33 PB, 26

[56] References Cited

U.S. PATENT DOCUMENTS

| | | | |
|---|---|---|---|
| 1,206,853 | 12/1916 | Jones | 100/29 X |
| 3,118,584 | 1/1964 | Brouse | 100/26 X |
| 3,120,171 | 2/1964 | Hall | 100/26 |
| 3,225,683 | 12/1965 | Rhea | 100/4 |
| 3,759,169 | 9/1973 | Goodley | 100/4 X |
| 3,949,662 | 4/1976 | Woodmer | 100/4 |
| 4,005,647 | 2/1977 | Goodley | 100/4 |

*Primary Examiner*—Billy J. Wilhite
*Attorney, Agent, or Firm*—Eugene G. Horsky

[57] ABSTRACT

A method and apparatus in which a strap looped about an article is tensioned by applying positive pulling forces to both the leading end and feed portions of such strap loop, after which such strap positions are sealed together. In certain embodiments of the invention, a strapping mechanism is supported on a carriage which is movable toward the article which is to be strapped, after which a strap looped about such article is tensioned by applying pulling forces to the leading end and feed portions thereof.

31 Claims, 16 Drawing Figures

A
C
P
S
III
IV
15
17
19
21
25
27
31
33
35
37
39
41
43
45
47
49
51
53
55
57
59
61
63
65
67
69
71
73
75
77
79
81
83
85
87
89
91
93
95
97
99
101
103
105
107
109
111
113
187
189
191
193
195

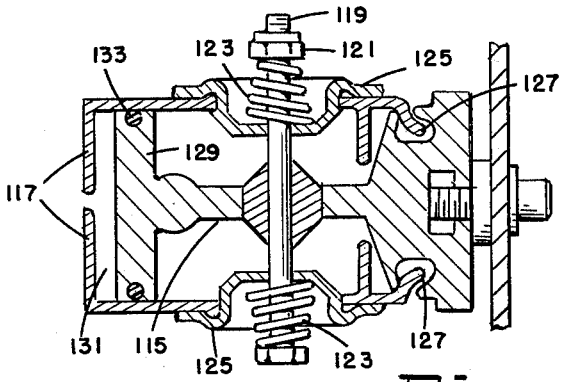
Fig. 4
Fig. 7
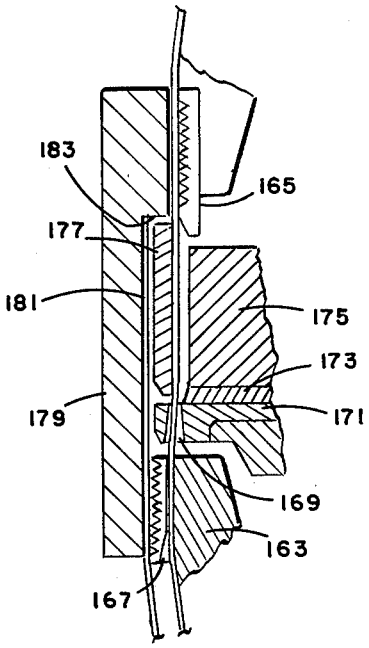
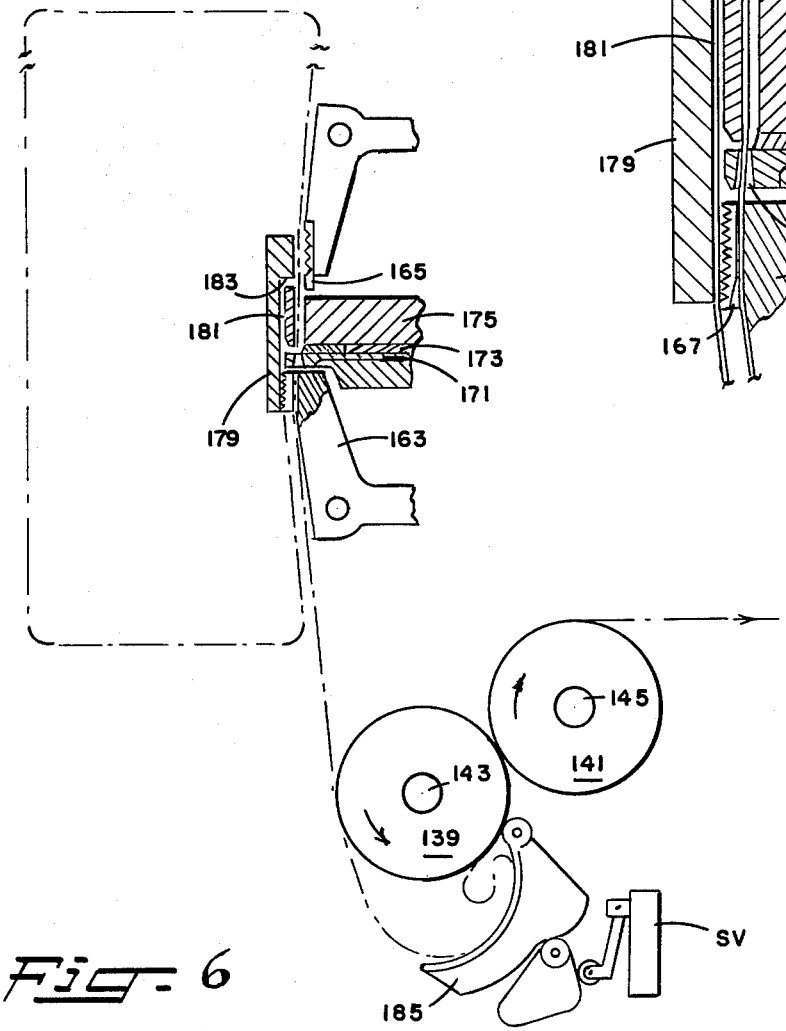
Fig. 6

ARTICLE STRAPPING METHOD AND APPARATUS

This application is a continuation-in-part of application Ser. No. 047,556, filed on June 11, 1979 and entitled ARTICLE STRAPPING METHOD AND APPARATUS, now abandoned.

The present invention is directed to an improved method and apparatus for applying a tensioned strap loop about an article.

Known in the art are automatic article strapping machines which include a yoke that communicates with a strapping mechanism and which together provide a generally continuous strap passage. In such machines, strap is fed from a supply into and along such passage to provide a loop in which leading end and feed portions of the strap are in overlying relationship. After the leading end portion of such strap loop is gripped, a pulling force is imposed on the feed portion of the strap to withdraw the strap from the passage as a loop and to apply the same in a tensioned condition about an article which is being strapped. The feed portion of the strap is then gripped and overlying leading end and feed portions of the strap loop are sealed together.

Known also in the art are semi-automatic strapping machines which include no yoke and in which the leading end portion of a strap fed from a supply is manually laced about an article which is being strapped and then inserted into position for gripping. Once such gripping occurs, the strap is tensioned as a loop onto the article by a pulling force applied to the feed portion of the strap, after which the leading end and feed portions of the tensioned strap loop are sealed together.

For simplicity and use of description, "strapping mechanism" or simply "mechanism" as employed herein encompass such mechanisms as include at least means for gripping the leading end portion of a strap after it has been looped or laced about an article to be strapped. Desirably, but not necessarily, means for sealing the overlying leading end and feed portions of the strap loop after tensioning thereof is completed are included as part of such mechanism. Means for holding or gripping the feed portion of the strap and for feeding and tensioning of the strap are of course necessary in the apparatus of this invention and may be mounted on portions of the apparatus separate from the strapping mechanism. In certain embodiments hereafter described one of such gripping, feeding and tensioning means is included as part of the strapping mechanism, while in still other described embodiments, all of such means are part of the strapping mechanism. A typical of such strapping mechanisms which includes means for feeding and tensioning of strap, for gripping the strap before and after the tensioning thereof, and for sealing of overlying portions thereof is described, for example, in U.S. Pat. No. 3,759,169 issued to G. F. Goodley.

Strapping mechanisms as described above may be housed below an article supporting table, as described in the cited Goodley patent, or as incorporated in conventional semi-automatic strapping machines, so that the strapped article has a bottom strap seal; that is, with overlying strap portions being sealed adjacent to the bottom of such article. Such strapping mechanism may also be oriented relative to the article supporting table so as to provide a tensioned strap loop having a seal along the top or side of the article or be employed in a pallet strapping machine or a horizontal strapping machine, for example as disclosed in U.S. Pat. No. 3,949,662, issued to W. H. Woomer, and U.S. Pat. No. 4,005,647, issued to Goodley et al., respectively, to provide an article with a side-sealed tensioned strap.

While such known strapping machines perform well, the application to articles of strap loops which are under still greater tension, without any or significant sacrifice in the advantages now provided by such machines, is desirable, if not essential, in certain article strapping operations. Accordingly, a primary object of this invention is to provide an improved strapping method and apparatus for applying tensioned strap loops about articles.

Another object is the provision of an improved method and apparatus for strapping of articles with tensioned strap loops in which tension variations along the length thereof are reduced or minimized during the application thereof.

Still another object is the provision of an improved method and apparatus for strapping of articles with tensioned strap loops which exhibit better tension maintenance characteristics.

A still further object is the provision of an improved article strapping method and apparatus in which friction encountered during tensioning of a strap loop about an article is significantly overcome.

A still further object is the provision of an improved article strapping method and apparatus which is adapted to apply a highly tensioned strap loop that is sealed along the bottom, top, or side of an article.

These and other objects are accomplished in accordance with the present invention by an improved strapping method and apparatus in which a strap loop is disposed about an article and tensioned to a high degree by imposing a pulling force on the leading end portion as well as to a feed portion thereof, after which overlying leading end and feed portions of the strap are sealed together to retain the strap loop in its tensioned condition about the article.

It will be understood that the terminology "imposing a pulling force", and similar language employed in the description and claims, involves the application of a pull on the feed and/or leading end portions of the strap that is looped about the article to be strapped so as to tension or still further tension the strap loop. For example, with a strap looped or laced about an article and gripped at its leading end portion, imposing a pulling force on the feed portion of the strap so as to move or retract the same will tension the strap loop onto the article and, while at least maintaining the tension in such strap loop, imposing a pulling force on the leading end portion of the strap as to move the same will still further tension the strap loop.

More particularly, as in conventional strapping procedures, the method of this invention involves feeding a strap longitudinally from a supply and lacing the same either through a yoke or manually along a path disposed in a plane and extending about an article which is to be strapped to provide a strap loop having the strap leading end and feed portions thereof in overlying relationship. While in conventional procedures tensioning of the strap loop is achieved by simply imposing a pulling force on the feed portion of the strap while the leading end portion of the strap is gripped, by the method of this invention the strap loop is tensioned about the article by imposing pulling forces on both the leading end and feed portions of the strap. Thus, by the method here described, a strap loop which has been tensioned about an article by imposing a pulling force on one of the leading end and feed portions thereof, is still further tensioned by imposing a pulling force on the other of such leading end and feed portions, after which the overlying leading end and feed portions of the now highly tensioned strap loop are sealed together.

In conventional strapping procedures, during the tensioning of a strap looped about an article, the movement of the successive strap segments which are between the feed and leading end portions thereof is progressively retarded by the cumulative friction that is developed. As a result, the leading end and feed portions of such tensioned strap are under significantly different tensions. Thus, a tension intermediate of these different tensions will exist in the strap length which is provided upon sealing of such leading end and feed portions. Moreover, the tension in this particular length of the applied strap loop will differ from those which exist in the strap lengths that are engaged with other faces of the strapped article, and especially the strap length which is most remote thereto. For example, in a strap loop applied to an article of rectangular configuration, that length of the applied strap loop which includes the sealed strap portions will be under a substantially greater tension than that existing in the strap length engaged with an article face opposite thereto. The different tensions along these lengths of the applied strap loop tend to equalize with time and/or movement of the strapped article, as during storage and/or shipment thereof, so that the entire applied strap loop may slacken somewhat.

On the other hand, by imposing a pulling force on the leading end portion of the strap loop, as well as feed portion thereof, in accordance with the method of this invention, the frictional forces acting upon the strap loop may be largely overcome. As a result, the tension in the strap length which is provided upon the sealing of such leading end and feed portions will be greater than that which is achieved by conventional procedures; that is, will more closely approach, or be equal to, or even exceed the tension which is applied to the feed portion of a strap loop by such conventional procedures. Moreover, by the method of this invention greater lengths of the applied strap loop are initially under tensions which at least approach the imposed pulling forces. Thus, as the overall initial tension in the strap loop is higher than is achieved by conventional procedures, and as a lesser degree of tension equalization can occur in the strap loop after overlying portions thereof are sealed together, the applied strap loop is retained snugly against the strapped article under a comparatively high tension.

As heretofore mentioned, in the method of the present invention, pulling forces are imposed on both the leading end and feed portions of the strap. These pulling forces are desirably imposed, at least in part, in sequence, and while the pulling force may be at least initially imposed on either the leading end or feed portion of the strap, it is most practical, and thus preferred, that a pulling force be imposed first on the feed portion of the strap. As such pulling force is imposed on the feed portion of the strap, the leading end portion of the strap is fixed to tension the feed portion of the strap and the strap looped about the article. As in conventional procedures, frictional forces retard the movement of the strap relative to the article and thus at this stage the tension in the feed portion of the tensioned strap loop will be greater than that in the leading end portion of such tensioned loop.

With the tension in the feed portion of the tensioned strap loop now being at least maintained, imposing a pulling force on the leading end portion of the strap will increase the tension in the strap loop. The pulling force imposed on the leading end portion of the strap may be less than, equal to, or greater than that imposed on the feed portion. Thus, if the pulling force imposed on the strap feed portion is simply maintained after the strap loop has been tensioned about an article, the pulling force imposed on the leading end portion may be: (a) less than that imposed on the feed portion of the strap so as to provide for some increase in the tension in the strap loop; (b) or may be essentially equal to that imposed on the feed portion of the strap; (c) or may be greater than that imposed on the feed portion of the strap but should not be of such magnitude as to cause the tensioned strap loop to simply move as a unit relative to the article.

Alternatively, once the pulling force imposed upon the feed portion of the strap tensions the strap loop about the article, such pulling force may be continued and increased while a pulling force is imposed on the leading end portion of the strap. In this instance, the pulling force applied to the leading end and feed portions of the strap may differ as heretofore described.

As a still further alternative, the feed portion of the strap may be fixed or held after a pulling force is imposed thereon to tension the strap loop about the article and the pulling force then imposed on the leading end portion of the strap may be less than, equal to, or greater than that imposed on the feed portion of the strap. In this instance, as the feed portion of the strap is fixed, the pulling force imposed on the leading end portion of the strap may significantly exceed the pulling force imposed on the feed portion of the strap without shifting of the tensioned strap loop and unit relative to the article.

Preferably, the leading end and feed portions of the strap are so gripped that, after tensioning of the strap loop is completed, overlying leading end and feed portions of the strap which are to be sealed are directly adjacent to the tensioned strap loop and are in a relaxed or only slightly tensioned condition. Thus, the sealed portion of the applied strap loop will be under a tension which may be less than, equal to or greater than that imposed on the feed portion of the strap loop prior to the sealing thereof, and in all instances will be greater than that achieved by conventional procedures.

As conventional strapping procedures involve feeding or lacing a strap along a path spaced from the article which is to be strapped, the leading end and feed portions of the strap loop will overlie and are normally sealed together at a location which is spaced from the strapped article. Thus, when such sealed strap portions are released from the position of sealing, the tension in the strap loop draws the same against the strapped article. Of course, this results in some sacrifice in the overall tension in the applied strap loop which may be tolerable, as when employing a semi-automatic strapping machine, or rather significant, as in strapping of pallet-supported articles where strap sealing generally occurs at a location spaced perhaps 3 or more inches away from the article.

Accordingly, in some embodiments of the method of this invention, it is preferred that, prior to imposing any tension onto a strap loop or during such tensioning, the overlying leading end and feed portions thereof are together moved a predetermined distance toward, and desirably directly adjacent to the article which is to be strapped. In this manner, the subsequently tensioned and sealed strap loop more closely approaches the perimeter of the article to which it is applied so that sacrifice in the overall tension in such strap loop is certainly minimized.

The apparatus of the present invention is similar to conventional strapping machines in that it includes a support, means for feeding a strap having leading end and feed portions for looping about an article which is to be strapped, and a strapping mechanism which includes at least means for gripping the leading end of a strap. As also present in such known machines, the apparatus of this invention includes tensioning means for imposing a pulling force on the feed portion of a strap looped about an article, means for use in holding or gripping such strap feed portion to maintain tension in a strap loop, and means for sealing overlying leading end and feed portions of a strap.

As such conventional machines generally include a housing, which is part of the machine frame, for containing the strapping mechanism, the apparatus of this invention is hereafter described as also including such housing as part of the support of the apparatus. Further, in both known strapping machines and in the apparatus of this invention strap guide means are provided which define a strap passage disposed in a plane. In the case of a semi-automatic strapping machine, such guide means assists in positioning the leading end portion of a strap for access and manual lacing as a loop about an article which is to be strapped, while in an automatic strapping machine, the guide means would include at least a yoke, and perhaps a lance in a pallet strapping apparatus, for lacing a strap as a loop about an article which is to be strapped. In both semi-automatic and automatic strapping machines, the strap is laced as a loop, preferably in the plane of the passage as defined by the guide means, with strap leading end and feed portions disposed in overlying relationship.

Distinguishing the apparatus of this invention from those known in the art is that the strapping mechanism is mounted for movement relative to the apparatus support or housing in the plane defined by the strap guide means. Further, the apparatus includes means for moving such mechanism between retracted and projected positions so that a pulling force may be imposed on the leading end portion which is gripped by the gripping means of such mechanism. Thus, with the apparatus of this invention, pulling forces of different magnitude may be imposed on the leading end and feed portions of a strap, and may be imposed sequentially so that a strap looped about an article may be tensioned about the article by imposing one of such pulling forces and then still further tensioned by imposing the other of such pulling forces.

The support of certain embodiments of the apparatus of this invention also differs from those of conventional machines in that it includes a fixed structure and a carriage. In such embodiments, the strapping mechanism and its housing are mounted on the carriage and means are provided for moving the carriage between retracted and projected positions, the latter of which is located near and desirably directed adjacent to the article which is to be strapped.

More specifically, in the apparatus of this invention, movement of the strapping mechanism between its retracted and projected positions is in the plane of the strap passage, and is achieved by a separate drive means. For example, in apparatus for strapping articles with side-sealed strap loops, such as with pallet strapping apparatus constructed in accordance with the present invention, movement of the strapping mechanism relative to its housing occurs along the vertical plane within which is disposed the strap passage, and is preferably achieved in at least one of its directions of movement by a drive means. Thus, if in such apparatus the strap loop within the strap passage is such that a downward pulling force is to be imposed on the leading end portion thereof during tensioning of the strap loop, part or all of the weight of the strapping mechanism may be relied upon to urge the same into its projected position to impose such pulling force. In this instance, the drive means may be used so as to supplement the gravitational force acting on the strapping mechanism and would also serve to elevate such strapping mechanism into its initial retracted position after strap loop sealing is completed. Alternatively, if in such apparatus the strap loop is such that during tensioning an upward pulling force is to be imposed on the leading end portion thereof, the drive means projects the strapping mechanism in such upward direction relative to its housing with a force such that its weight is more than counterbalanced. In this instance, the strapping mechanism may be returned to its initial retracted position by gravity after strap loop sealing has been completed.

Regardless of the direction and/or manner of movement of the strapping mechanism relative to its housing, during tensioning of the strap loop, it is preferred that the strap tensioning means first performs its intended tensioning function on the feed portion of the strap loop and then at least maintains such tension while and until the pulling force imposed on the leading end portion of such tensioned strap loop achieves the intended supplemental loop tensioning. This sequence is most practical as it insures that the pulling force imposed on the leading end portion of the strap loop does not assume all or part of the function of the strap tensioning means and is not merely compensated by tension relaxation along the feed portion thereof but does, in fact, achieve increased tension in the strap loop.

As mentioned, in certain embodiments of this invention the strapping mechanism and its housing are supported by a carriage which is also capable of movement in the plane of the strap passage, but in a direction generally perpendicular to the direction of movement of the strapping mechanism relative to its housing. For example, in a pallet strapping apparatus, as the strapping mechanism would be moved vertically along the plane of the strap passage to impose a pulling force on the leading end of a strap loop, as described above, the carriage would also be moved within this same plane, but in a horizontal direction. The function of such carriage is to position the strapping mechanism close to and desirably directly adjacent to the article which is being strapped. Thus, in such pallet strapping apparatus, in the retracted position of the carriage the strapping mechanism and housing are aligned with a yoke and together define a strap passage, while in a projected position of the carriage the strapping mechanism is close to the article which is being strapped.

In a horizontal strapping apparatus constructed in accordance with present invention, the carriage would likewise serve to project the sealing mechanism directly adjacent to the article which is to be strapped. Movement of the carriage between its retracted and projected positions would occur in the horizontal plane of the strap guide means and would be in a direction perpendicular to the movement of the strapping mechanism in such same horizontal plane.

The presence of the carriage in such embodiments of the apparatus of this invention in no way interferes with the feeding of strap into and along the strap passage or in the delivery of articles into and/or from the apparatus, yet it facilitates the application of tensioned strap loops which more snugly grip the strapped article. In general, carriage movement between retracted and projected positions of from about 3 to 12 inches is desirable and, preferably, control means are provided to insure that tensioning of a strap loop occurs only after such carriage has assumed its projected position.

The method and apparatus of the present invention are applicable for use with a variety of articles which may vary in size and/or shape and which may consist, for example, of a single unit or package or a series of units or packages in a stacked array.

The term "strap" and "strapping" as used herein are intended to include conventional flat, narrow elongated flexible structures which are capable of being fed longitudinally, and particularly but not limited to, structures which are formed of synthetic thermoplastic materials, such as, polypropylene, nylon, and polyesters, which have been stretched and/or rolled to orient the molecules thereof. Further, the term "sealing" as employed herein includes connecting of overlying strap portions, as by thermal welding, metallic seals, adhesives, and the like. Preferably, but not by way of limitation, thermal softening of opposing surfaces of overlying portions of plastic strap is achieved as described in the above cited Goodley patent.

For the sake of simplicity and ease of description, the present invention is hereafter described in detail as employed in strapping of pallet-supported articles and, more particularly, employing a machine as disclosed in the above cited Woomer patent, into which are incorporated the teachings of the present invention. In addition, embodiments of semi-automatic strapping apparatus incorporating the teachings of this invention are described to illustrate the wide applicability of this invention.

In the drawings, FIG. 1 is a side view of one embodiment of the apparatus of the present invention, with portions thereof broken away;

FIGS. 3 and 4 are fragmentary views of a portion of the apparatus as seen in the direction of arrows III—III and IV—IV, respectively, in FIG. 1;

FIGS. 6 and 7 are fragmentary diagrammatic views showing details of the strapping mechanism illustrated in FIG. 5;

Figures 1, 3:
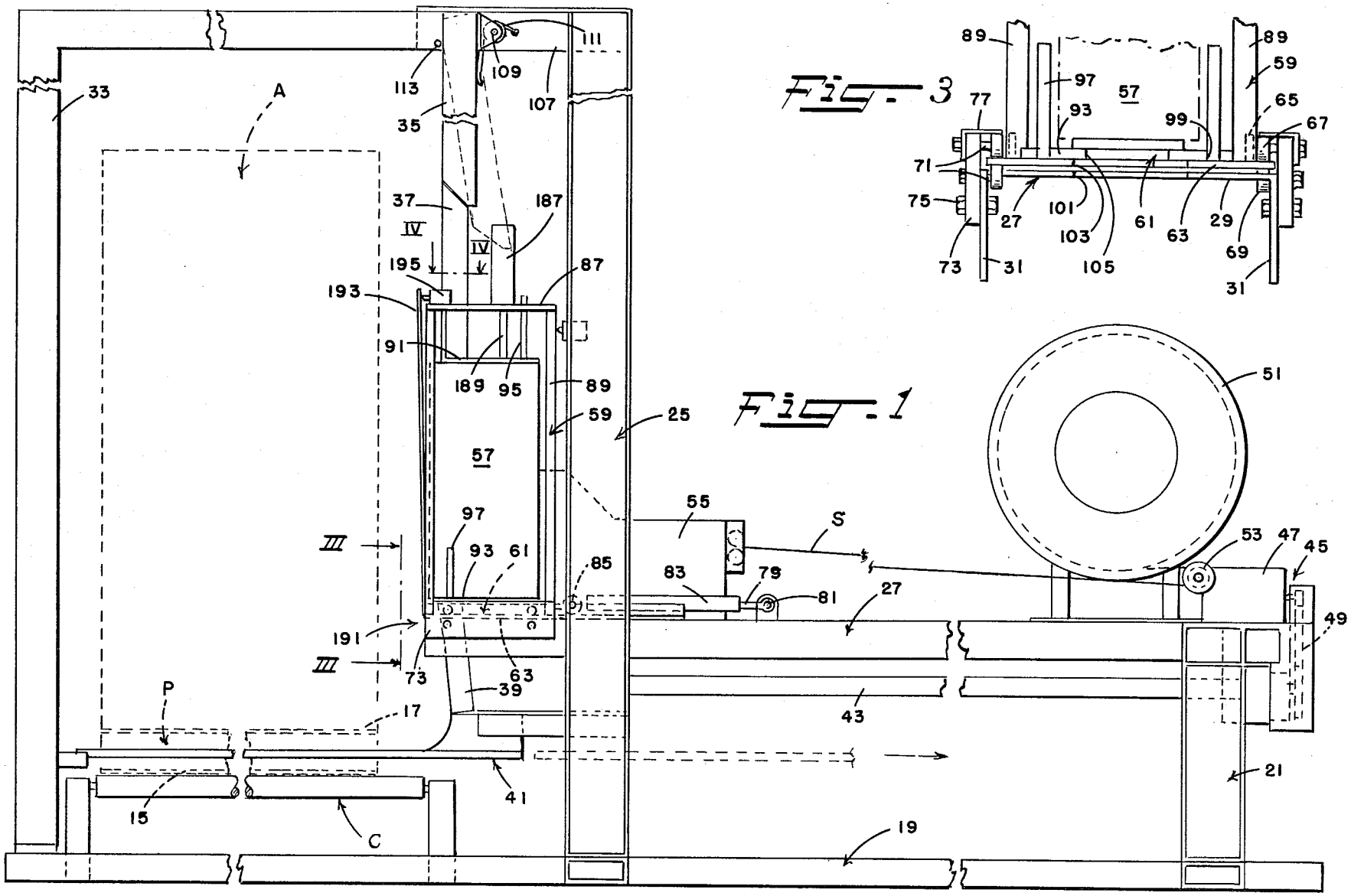
Figure 9:
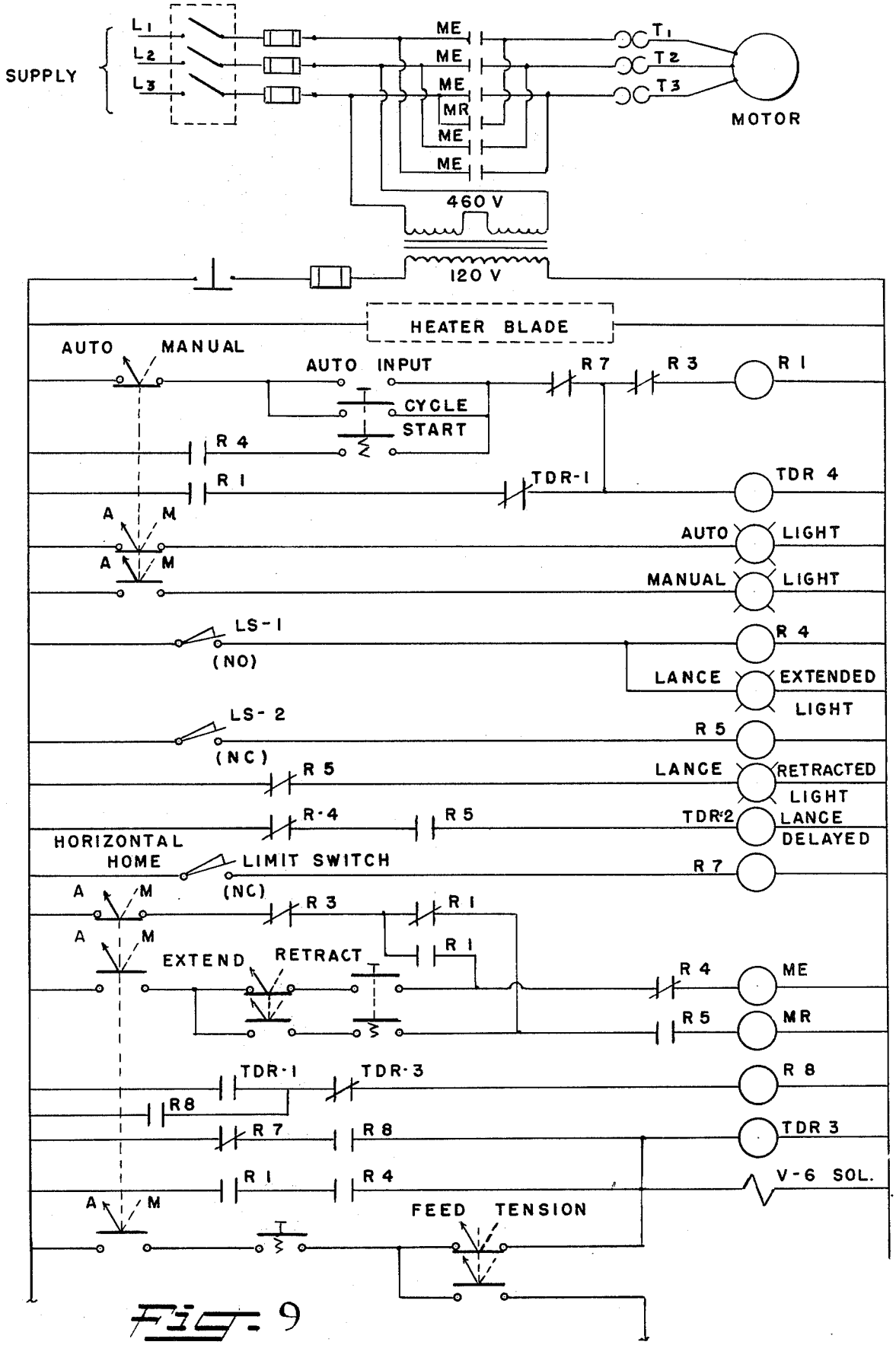
Figure 10:
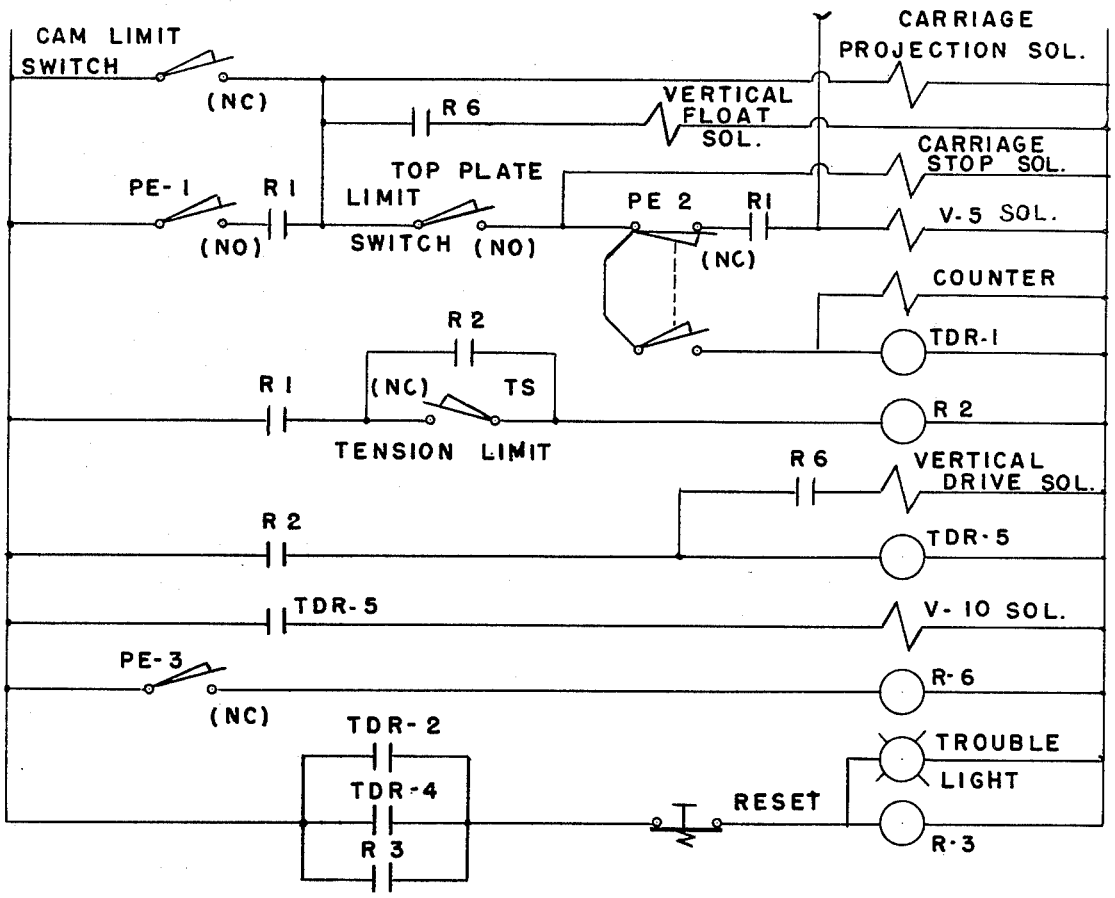
Figure 11:
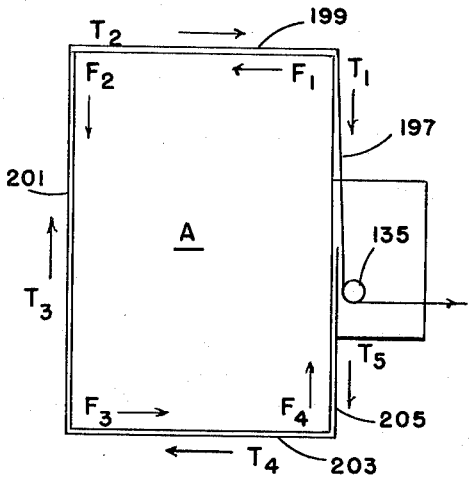
Figure 12:
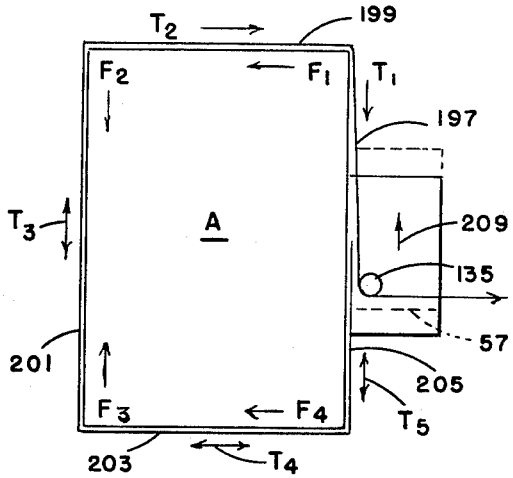
Figure 13:
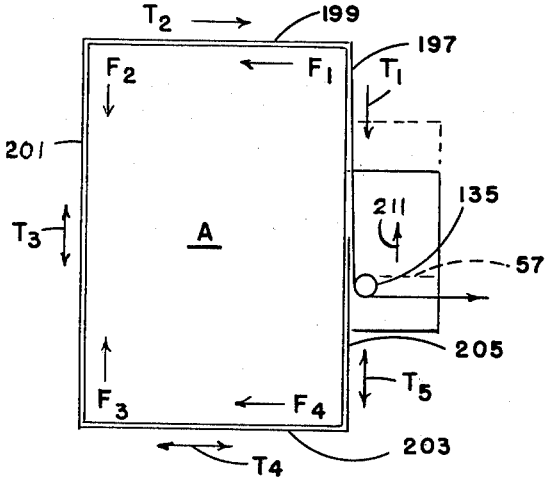
Figure 14:
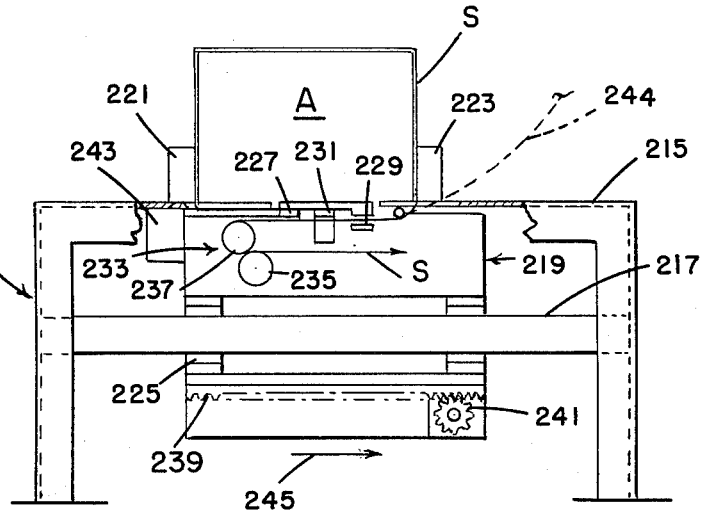
Figure 15:
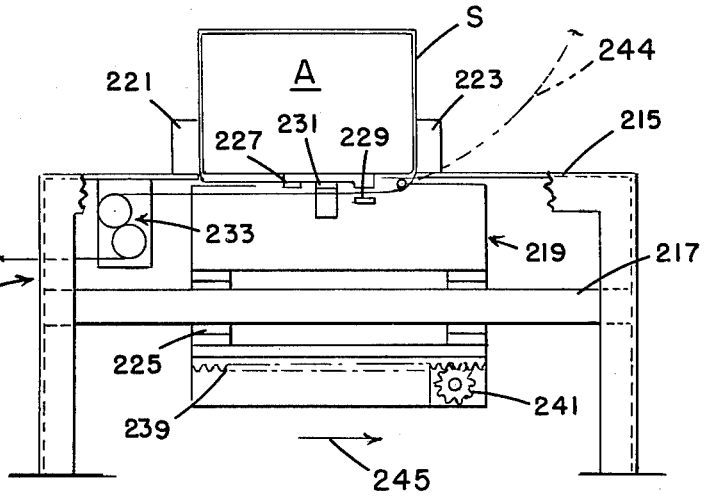
Figure 16:
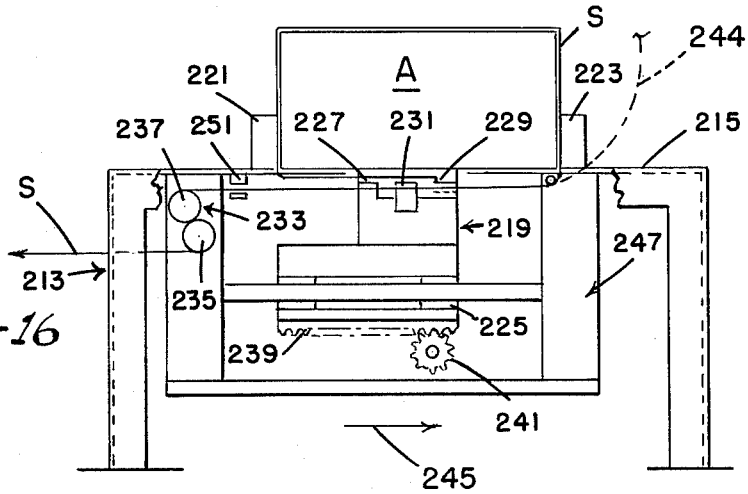

FIGS. 9 and 10 together are a diagram of the electrical system of the apparatus shown in FIG. 1;

FIGS. 11, 12, and 13 are schematic views showing the apparatus of this invention during various stages of its operation; and FIGS. 14, 15 and 16 are embodiments of semi-automatic strapping machine incorporating the present invention.

Figure 2:
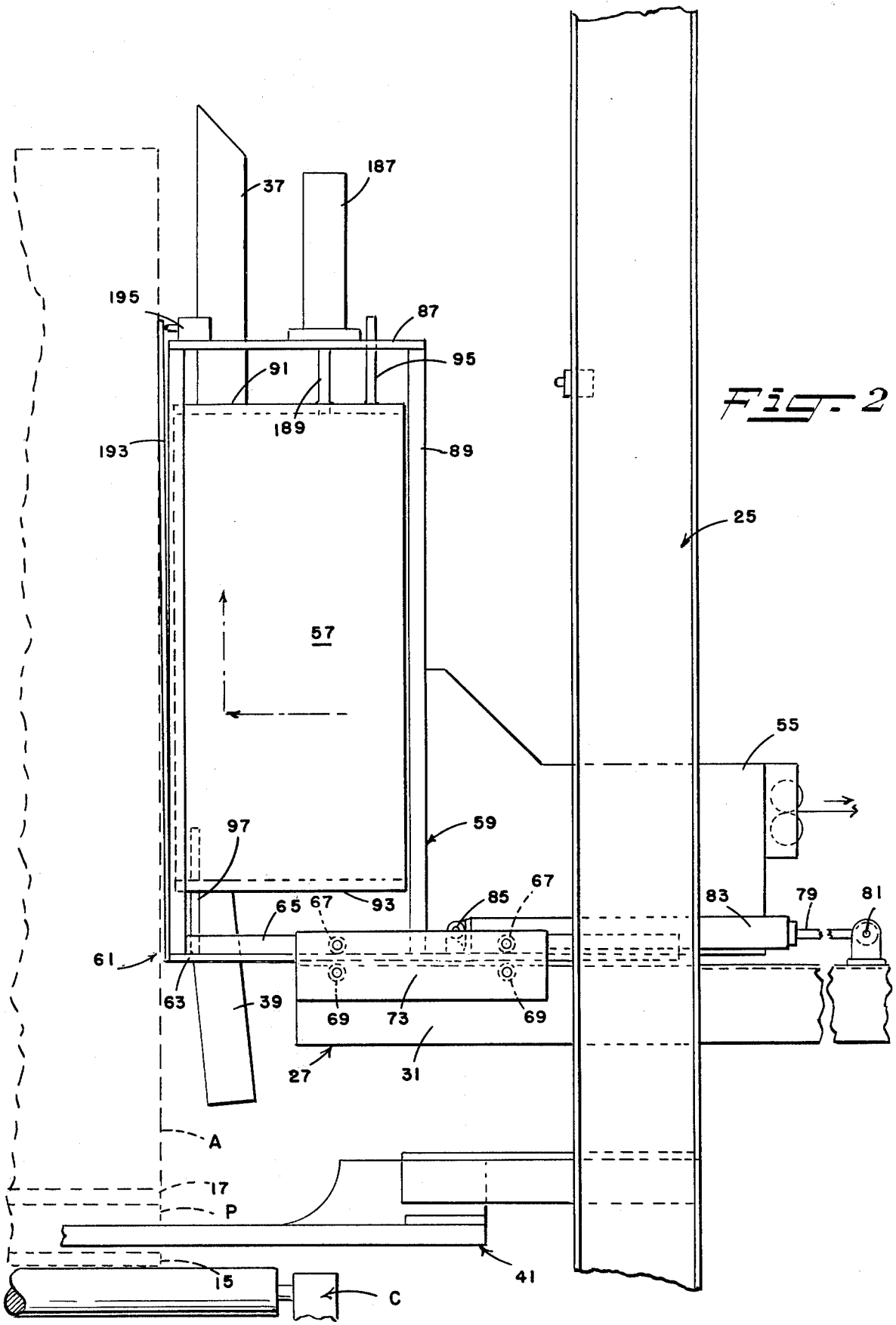
FIG. 2, illustrates on an enlarged scale, a portion of the apparatus shown in FIG. 1 in its operative position.

The apparatus of FIGS. 1–13 is adapted to be integrated into a production or packaging system and is illustrated in FIGS. 1 and 2, in position to apply tensioned strap loops about articles A which are carried by pallets P and delivered by a conventional roll conveyor C. The pallet P is of the conventional two-deck construction having a lower deck 15 and an upper deck 17 which are secured to spacers disposed between such decks.

The overall appearance of this apparatus and certain stages of its operation are similar to the pallet strapping machine disclosed in U.S. Pat. No. 3,949,662, issued to W. H. Woomer. Thus, where such similarities exist reference will be made to this cited Woomer patent for the sake of brevity.

Turning to FIGS. 1–3 of the drawing, the apparatus has an appropriate support or framework which includes a base 19, a pair of laterally spaced columns 21, a pair of laterally spaced uprights 25 and a channel 27 connected inwardly of its ends to the columns 21 and uprights 25 with web 29 and flanges 31 disposed as shown in FIG. 3. Means for guiding strap about an article A includes yoke sections 33, 35, 37 and 39 and a lance 41, the latter of which is supported and reciprocated between a retracted position and a projected position, as indicated by broken and solid lines as shown in FIG. 1, by a shaft 43. Rotation of the shaft 43 is by a mechanism as indicated at 45 which includes an electric motor 47 and a chain 49.

Strap S which is to be applied to article A is drawn from a supply coil which is carried by a suitable dispenser 51 fixed to the channel 27. As strap S is drawn from the supply coil, it is passed about a dancer arm roll 53 and led by rolls into and through a strap accumulator 55 and into a strapping mechanism which is indicated generally by the character 57. In this embodiment, and as hereafter described in detail, the strapping mechanism includes means for gripping both the leading end and feed portions of strap, means for feeding and applying tension to the feed portion thereof, and means for sealing overlying portions of the strap after pulling forces are applied to its feed and leading end portions.

The apparatus of the present invention thus far described in detail is generally similar to known pallet strapping machines, such as that disclosed in the cited Woomer U.S. Pat. No. 3,949,662. However, differing significantly from such known machines is that the strapping mechanism 57 of the apparatus of the present invention is mounted for vertical movement relative to a housing, which is indicated generally at 59, and that such housing 59 is in turn supported on a carriage 61 which is movable horizontally between a retracted and a projected position as shown in FIGS. 1 and 2. In this embodiment, both the housing 59 and carriage 61 are considered to be part of the apparatus support.

More specifically, as best shown in FIGS. 2 and 3 the carriage 61 includes a slide plate 63 which is stiffened by bars 65 and is supported and guided for horizontal movement by a series of rollers 67 and 69. Roller spindles 71 are mounted on plates 73 which are bolted at 75 to the vertical flanges 31 of the channel 27. The rollers 69 project through suitable openings in the channel web 29 to elevate and thus provide for free movement of the slide plate 63 relative to such web 29. Angle members 77 are also fixed to the plates 73 to provide a guard for rollers 67. Linear movement is imparted to the carriage 61 by a conventional pneumatic cylinder assembly having a piston rod 79 pivoted at 81 to the channel 27 and a cylinder 83 pivoted at 85 to the slide plate 63.

The housing 59 may consist simply of a top plate 87 and corner angle sections 89 which are fixed to the carriage 61, while the strapping mechanism 57, includes top and bottom plates 91 and 93 which extend laterally beyond the remainder of such mechanism. Rod 95 is fixed to the top plate 91 of the strapping mechanism 57 and extends freely through an opening in the housing top plate 87 and similar rods 97 are fixed to the carriage slide plate 63 and project through openings 99 in the bottom plate 93 of the strapping mechanism 57 for guiding the same during its movement in a vertical direction, as hereafter described. Obviously, the area between the strapping mechanism 57 and the article A must be unobstructed and thus the channel web 29, carriage slide plate 63 and the bottom plate 93 of such strapping mechanism 57 are provided, respectively, with slots 101, 103, and 105 which are aligned with each other, with a similar slot being formed also in the top plate 87 of the respective housing 59.

As shown in FIG. 1, in the retracted position of the carriage 61, the yoke sections 33, 35, 37 and 39 and the lance 41 cooperate with the strapping mechanism 57 to provide a generally continuous passage through which the strap S may be longitudinally fed to form a strap loop about the article A. The yoke section 33 is fixed to the base 19 and by braces 107 to the uprights 25, while the yoke section 35 is hinged at 109 for swinging movement as indicated by broken lines. Under the action of a torsion spring 111 the yoke section 35 normally assumes its position as shown in solid lines in which it bears against a stop pin 113.

Figure 5:
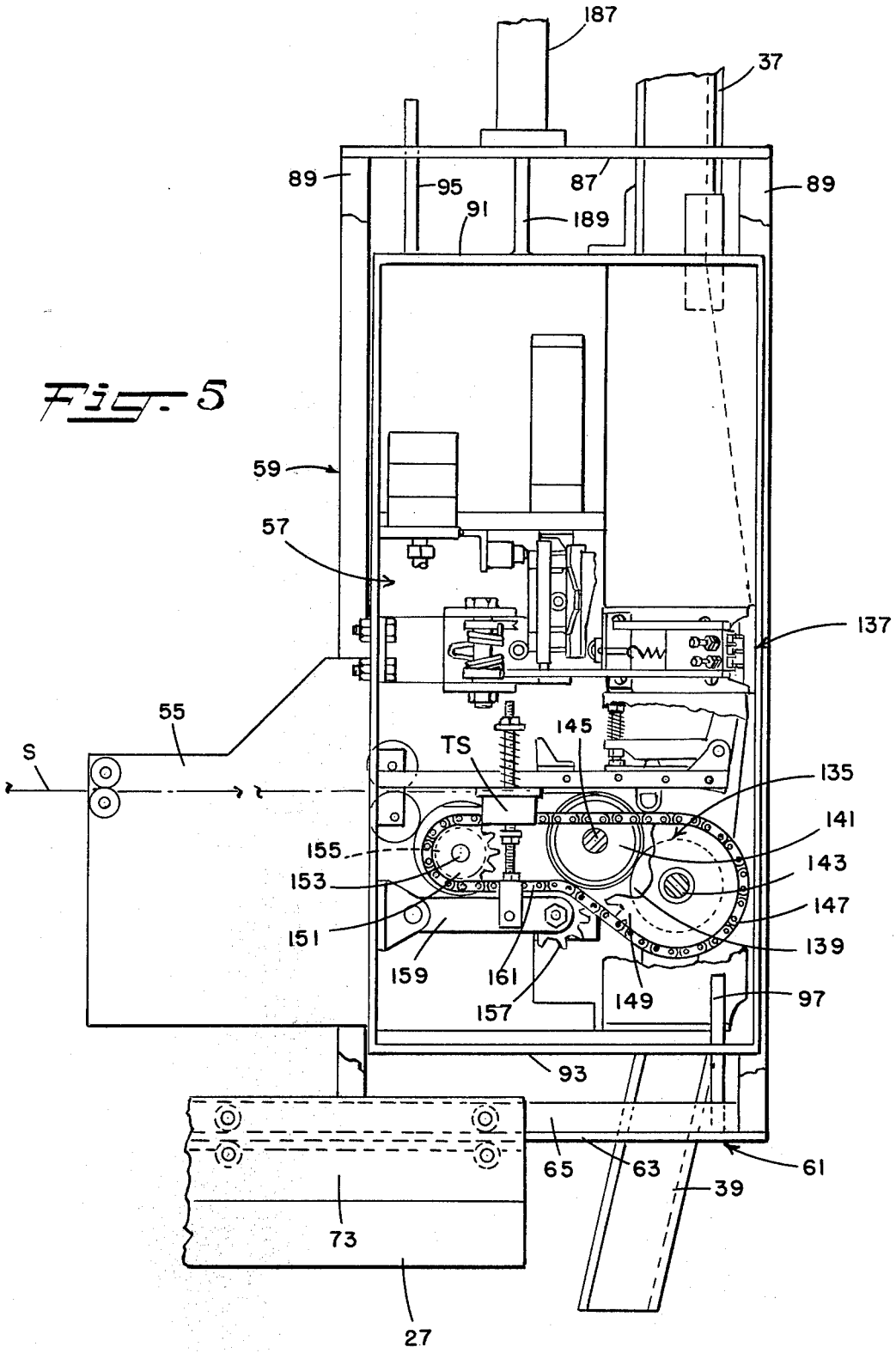
FIG. 5 is a partial side view showing elements of the strapping mechanism as seen from the side opposite that shown in FIGS. 1 and 2.

During lacing, the leading end portion of the strap fed by the strapping mechanism 57 is guided into the yoke section 35 by the yoke section 37 and, after travelling along the yoke section 33 and the lance 41, is returned into the strapping mechanism 57 by the yoke section 39. Turning to FIG. 5, the yoke sections 37 and 39 are fixed only to the strapping mechanism 57 and are free to move relative to the slide plate 63 and the top plate 87 of the housing during vertical travel of such strapping mechanism.

The yoke sections 33, 35, 37 and 39 are of conventional construction, and typical of such construction is the yoke section 37 shown in FIG. 4. This yoke section 37 includes a beam 115, gates 117, a gate retainer bolt 119 and nut 121, springs 123 and spring cups 125. The gates 117 are pivoted at 127 to the beam 115 and together with the beam flange 129 define a passage 131 for the strap S. During tensioning of strap laced through the yoke section, the gates 117 are pivoted apart by the tensioned strap, the strap is released, and the springs 123 return the gates 117 to their illustrated positions, with their movement being dampened by resilient inserts 133.

The strapping mechanism 57, except for its capability of moving vertically relative to the housing 59, and certain control aspects, is essentially the same as disclosed in the cited Woomer patent. Only such details of the strapping mechanism 57, including its control systems, sufficient to provide an understanding of the invention will be described herein. Other aspects thereof are described fully in the cited Woomer and Goodley patents which are incorporated herein by reference.

The strapping mechanism 57, as shown in FIG. 5, includes strap feed and tensioning means indicated at 135 which serves to draw strap from the supply coil, and feed the same longitudinally through a gripper assembly 137 and up into and through the yoke segment 37. After travelling sequentially along the sections 35 and 33 and the extended lance 41, and the yoke section 39, the leading end portion of the loop of strap thus fed about the article A returns to the strapping mechanism 57 and is gripped by the gripper assembly 137. During subsequent tensioning, the strap loop is pulled snugly against the article A, with the strap that is withdrawn during such tensioning being collected within the accummulator 55.

More specifically, and with reference to FIGS. 5–7, the strap feed and tensioning means 135 includes tensioning and feed wheels 139 and 141 which are mounted on shafts 143 and 145, respectively, and geared together by gears, not shown. The shaft 143 is driven by a chain 147 passing around a sprocket 149 fixed to such shaft 143 and a sprocket 151 fixed to a shaft 153 of a reversible air motor 155. By means including an idler sprocket 157 and pivot arm 159, the tension in the lower reach 161 of the chain 147 is sensed so as to actuate a tension switch TS, and cause the air motor 155 to install when the strap loop being applied to the article A is under a predetermined tension, as hereafter described in detail.

The gripping assembly 137, as best shown in FIGS. 6 and 7 includes front and rear grippers or holding means 163 and 165, respectively. During initial feeding, the strap S passes through an aperture 167 in the front gripper 163, an aperture 169 in a fixed shear plate 171, past a cutoff knife 173, between a movable sealing platen 175 and a retractable tongue 177 and between the rear gripper 165 and a retractable anvil 179. With continued feeding of the strap along the generally continuous passage as heretofore described, the leading end portion 181 of the strap passes between the front gripper 163 and the anvil 179 and between the tongue 177 and such anvil 179 until it strikes a stop 183. The rotation of the wheels 139 and 141 continues but as an overfeed loop of strap develops at the tension wheel 139, a pivot flag 185 is moved to operate a strap limit valve SV which causes the front gripper 163 to close and grip the strap leading end portion 181 and stop the air motor 155.

The elements of the strapping mechanism 57 described above relating to the feeding, gripping, sealing and cutting of the strap are essentially the same as described in the cited Goodley and Woomer patents and, preferably, the operation of these elements is effected by the linear activator and cam assembly as described in these cited patents.

In the illustrated embodiment, this upward movement of the strapping mechanism 57 into a projected position is achieved by a pneumatic means which includes an air cylinder 187 fixed to the housing top plate 87 and a piston having an operating rod 189 connected to the top plate 91 of such strapping mechanism 57.

Figure 8:
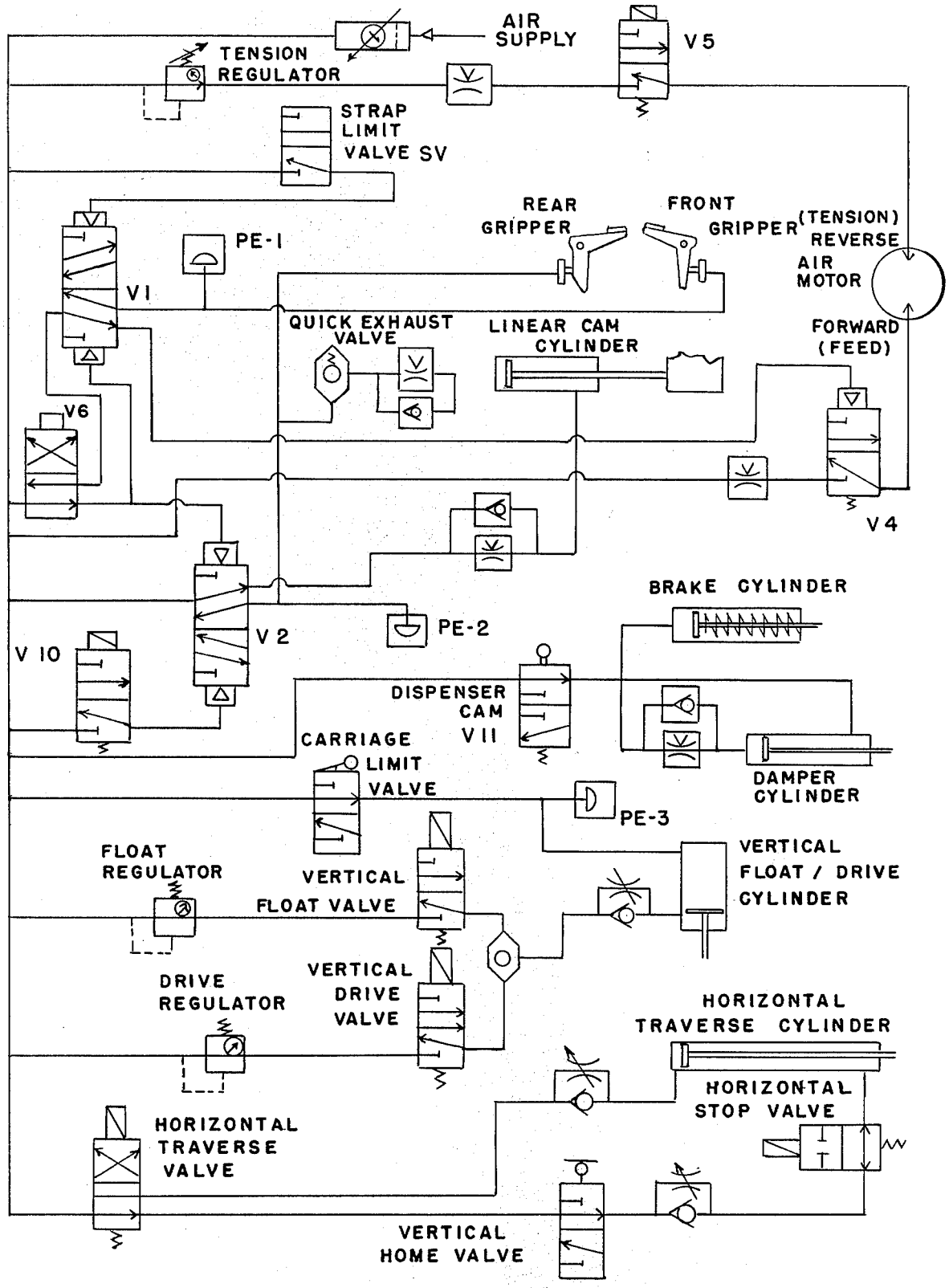
FIG. 8 is a diagram of a pneumatic system incorporated in the apparatus shown in FIG. 1.

In describing the sequence of an operational cycle in accordance with the preferred method of this invention, reference is made primarily to FIGS. 8–10 and to the schematic views shown in FIGS. 11–13. To better appreciate the functions of the various control elements, it will be understood that the apparatus is in condition for performing an operational cycle when the strapping mechanism 57 in its home or retreat position, the carriage 61 also in its home or retracted position and the strap S having been pre-fed along the yoke sections 37, 35 and 33.

To assist in the understanding of the operational cycle, the function of certain of the limit and pressure electric switches is provided as follows:

LIMIT SWITCHES

Limit switches LS-1 and LS-2 control the extension of the carriage lance mechanism 45 by deenergizing motor starter relay ME (motor extend) and motor starter relay MR (motor retract) respectively.

The horizontal home limit switch indicates the position of the carriage 63. When the carriage is fully retracted, it deenergized relay R-7 to allow strap feeding through the yoke at the beginning of a machine cycle or at the end of a strapping cycle to pre-feed the yoke.

The top plate limit switch 195 when actuated energizes the carriage stop solenoid valve to stop movement of the carriage 63 and initiates strap tensioning.

The cam limit switch controls the descent of strapping mechanism 57 and retraction of the carriage 63.

PRESSURE ELECTRIC SWITCHES-PE

Switch PE-1 initiates extension of the carriage 63. Switch PE-2 is actuated when the strap is fully tensioned and controls linear cam dwell. In the preferred embodiment here described, the switch PE-3 controls relay R-6 which will not energize and allow vertical floating or driving of the strapping mechanism 57 should the carriage 63 not move a predetermined distance toward the article A.

Initiation of a machine cycle begins by either depressing the Cycle Start pushbutton or by an input signal energizing relay R-1. This will energize the machine cycle timer TDR-4 and the motor starter relay ME (motor extend) starting the motor 47 and causing the lance 41 to extend through the void in the pallet P. Upon lance extension of approximately one inch, the rear limit switch LS-2 is closed, energizing the relay R-5 which causes the "lance retracted" light to be extinguished, energizes the lance blockage timer TDR-2, and prepares the motor starter relay MR (motor retract) for retracting the lance 41 at the end of the strapping cycle.

Upon full extension of the lance 41, the front limit switch LS-1 will close, thereby energizing the relay R-4 and illuminating the "lance extended" light and deenergizing the lance delayed timer TDR-2. In the event that the front limit switch LS-1 does not close, as when the lance 41 is blocked during its extension, the relay R-4 will not be energized and the lance delayed timer TDR-2 will time out, illuminating the "trouble" light and energizing the relay R-3. This, in turn, deenergizes the relay R-1 and halts the machine cycle. Upon depression of the reset button, the lance 41 will be retracted into its original stowed position.

With the energization of the relay R-4 as described above, the motor starter relay ME (motor extend) will be deenergized thereby stopping the motor 47. At this time the solenoid valve V-6 will actuate the valve V-4 so as to direct air into the air motor and cause strap S to feed through the strapping mechanism 57 and along the yoke sections 37, 35 and 33, the lance 41 and the yoke section 39 until its free end 181 contacts the stop 183. The strap S then starts to buckle and a loop of strap develops at the tension wheel 139, causing the flag 185 to pivot actuating the strap limit valve SV which shifts the valve V-1. Air is now directed to the front gripper 163 which grips the strap free end portion 181 against the anvil 179.

At this time, the pressure electric switch PE-1 is activated, energizing the carriage projection solenoid valve which directs air to the piston side of the air cylinder 83 and causes the carriage 61 to be projected toward the article A which is to be strapped. Upon a predetermined travel of the carriage 61, the carriage limit valve opens to the atmosphere, exhausting air from the piston side of the vertical float/drive cylinder 187 and activating the switch PE-3. As the switch PE-3 is closed, the relay R-6 is energized, thereby activating the vertical float cylinder 187. The air pressure is regulated by the float pressure regulator at such pressure as to provide a force to the cylinder rod 189 as might be necessary to counterbalance the weight of the entire strapping mechanism 57, thus this mechanism 57 is prepared for counterbalancing after the pulling force is applied to the feed portion of the strap S.

Hinged at 191 to the housing 59 are top plates 193 which, when engaged with the article A during carriage projection, pivot and actuate a top plate limit switch 195 that energizes the carriage stop solenoid and energizes the solenoid V-5. At this stage, with the horizontal traverse or projection of the carriage 61 now halted, the solenoid valve V-5 directs air into the air motor for strap tensioning. When this strap is tightened sufficiently around the article A to move the idler sprocket 157, shown in FIG. 5, the tension limit switch TS is disengaged, thus closing its contact and the relay R-2. This stage is illustrated in FIG. 11 and shows the strap as would be tensioned to its maximum degree by conventional strapping methods and machines. However, with the embodiment of the apparatus of this invention here described in detail, closing of the relay R-2 energizes the tension delay timer TDR-5 and the vertical drive solenoid valve which pressurizes the cylinder rod side of the vertical float/drive air cylinder 187. The air input is regulated by the drive regulator which is set at a pressure which will provide a force to the cylinder rod 189 such that, taken with any upward force exerted on the mechanism 57 by the tensioned strap, the weight of the entire strapping mechanism 57 is counterbalanced.

When the drive regulator is set such that the force applied to the cylinder rod 189 provides for counterbalancing the weight of the strapping mechanism 57, the apparatus is now conditioned to impose a pulling force on the leading end portion of the strap which at least more closely approaches, and desirably equals the pulling force applied to the feed portion of the strap loop so that the tensions in such strap portions, are generally the same. This stage is shown in FIG. 12.

Thus, when the drive regulator is set so that the force applied to the cylinder rod 189 is greater than that necessary to counterbalance the strapping mechanism 57, the mechanism 57 is driven upwardly with a force such that the pulling force acting on the leading end portion 181 of the strap loop more closely approaches or equals that acting upon the feed position of such strap loops. This stage is illustrated in FIG. 13.

As the solenoid valve V-5 is still energized, the air motor continues to tension the strap, stalling the air motor 155. The tension regulator regulates the air pressure through the solenoid valve V-5 which, in turn, regulates the amount of torque the air motor 155 will provide. Once the tension delay timer TDR-5 times out, the solenoid valve V-10 is energized providing air to shift the valve V-2 which, simultaneously, actuates the switch PE-2 to deenergize the valve V-5. As a result, strap tensioning is stopped, the linear cam dwell timer TDR-1 is energized, the rear gripper 165 is actuated to clamp and hold the feed portion of the strap loop against the anvil 179, and air is directed to the piston side of the linear cam cylinder which extends the linear cam.

As this linear cam extends, the cam limit switch closes and after the tensioned strap is cut and sealed, the linear cam dwell timer TDR-1 times out and deenergizes the relay R-1. The motor starter relay MR (motor retract) is thereby energized so that the lance 41 is withdrawn, and the relay R-2 is also deenergized, as are the vertical drive solenoid valve and the tension delay timer TDR-5. The latter deenergizes the solenoid valve V-10.

The timing out of the linear cam dwell timer TDR-1 also energizes the relay R-8 which holds itself in, and also deenergized by the relay R-1 is the solenoid valve V-6 so that air passes through solenoid valve V-6 to shift the valves V-1 and V-2. Once shifted, the valve V-2 exhausts air from the rear gripper 165 and directs air to the rod side of the linear cam cylinder, retracting the cam and thus opening the anvil 179 to eject the strap and open the cam limit switch. In addition, its switch PE-2 returns to its normal position. The shifted valve V-1 exhausts air from the front gripper 163 and allows the switch PE-1 to return to its normally open position.

The carriage projecting solenoid valve, the carriage stop solenoid valve, and the vertical float solenoid valve are now deenergized, but the carriage 61 will not retract until the strapping mechanism descends to close the vertical home limit valve. Once this has been achieved, and the carriage 61 is retracting, the carriage limit valve will actuate, pressurizing the piston side of the vertical float/drive cylinder, and the switch PE-3 deenergizes the relay R-6.

Upon full retraction of the carriage 61, the horizontal home limit switch is actuated, deenergizing the relay R-7 which, in turn, energizes the pre-feed cycle timer TDR-3 and the solenoid valve V-6. Air is now directed to the pilot of the valve V-4 which actuates and directs air to the air motor 155, again feeding strap S through the strapping mechanism and yoke sections 37, 35 and 33. When the pre-feed cycle timer TDR-3 times out, it denergizes the relay R-8 which, in turn, deenergizes the pre-feed cycle TDR-3 and solenoid valve V-6 which stops the air motor 155 and halts the feeding of strap.

Turning again to FIGS. 11-13, at the stage shown in FIG. 11, the strapping mechanism 57 is disposed directly adjacent to the article A which is being strapped, the leading end portion 181 of the strap loop is gripped and such loop is being tensioned onto the article A by the tensioning means 135. The tension in the respective portions or legs 197, 199, 201, 203, and 205 of the applied strap loop are indicated at T1, T2, T3, T4 and T5, with the frictional forces which retard the movement of the strap loop during tensioning, particularly at the article corners are indicated as F1, F2, F3 and F4.

Obviously, the tension in the strap loop decreases progressively along the length thereof, from a maximum tension T1 to a minimum T5. As the tension $T5=T1-F1-F2-F3-F4$, if the leading end and feed portions of the applied strap loop were to be sealed at this stage, the tension in the side of such sealed strap loop formed by the legs 197 and 205 would be intermediate to that of T1 and T5.

In accordance with this embodiment of the present invention, and as illustrated in FIG. 12, after and during continued tensioning of the strap loop by the tensioning means 135, the strapping mechanism 57 is urged upwardly with such force that its weight is counterbalanced as indicated by the arrow 209.

By applying an upward force to the strapping mechanism 57 which is greater than the weight of such mechanism 57, as indicated by the arrow 211 in FIG. 13, the legs 197 and 199 of the strap loop are under tensions T1 and T2, as developed by the pulling force imposed by the tensioning means 135. The legs 205 and 203 are under tensions T5 and T4 which are applied by the projected strapping mechanism 57 and, desirably approach or are equal to the respective tensions T1 and T2, while the tension T3 in the leg 201 of the strap loop is that which extends generally equally toward opposite ends thereof, as applied by the tensioning means 135 and the projected strapping mechanism 57. More specifically, desirably $T1=T5$ *and* $T2=T1-F1=T4=T5-F4$, while $T3=T2-F2=T4-F3$ and is greater than that achieved in FIG. 11.

Upon sealing of the legs 197 and 205 of the strap loop, the tension in the resulting side of applied strap will be equal to the tension originally existing in such legs or T1 which is equal to T5.

The upward driving force imposed on the strapping mechanism 57, as indicated by the arrow 211 in FIG. 13, will depend upon the frictional forces which are encountered during the strapping of a particular article A and which, in turn, depend on the characteristics of the strap S which is being applied, such as its lubricity and surfaced smoothness. Obviously, frictional forces, such as F1, F2, F3 and F4, will exist and, while the strapping mechanism 57 may be driven upwardly with a force which is greater than the weight of such mechanism, such upward driving force should not be such as to lift the article A or to exceed the retarding frictional forces, such as F1, F2, F3 and F4, so as to cause the loop of strap to slide as a unit relative to the article A.

While the preferred operational sequence of the embodiment of the invention shown in FIGS. 1-13 has been described in detail, the described apparatus may be operated without projection of the carriage 61. In this instance, the upward movement of the strapping mechanism 57, under a force equal to or greater than its weight, will cause the yoke section 37 which is carried thereby to deflect the yoke section 35 as indicated by broken lines in FIG. 1. Upon the subsequent sealing of the leading end and feed portions of the strap loop, the sealed side thereof is urged against the side of the strapped article in much the same manner as with conventional apparatus. Yet, insofar as the leading end and feed portions of the strap loop are under tensions which at least approach each other prior to the sealing thereof, the overall tension in the applied strap loop is greater than that which is achieved with such conventional apparatus.

In the embodiment of the invention described in detail, the tensioning means 135 is operated to tension the strap loop onto the article A, as shown in FIG. 11, and is kept in operation to maintain the tension in such strap loop while a pulling force is applied to the leading end portion or leg 205 of the strap loop in a manner as illustrated in FIGS. 12 and 13. Maintenance of the tension developed in the strap loop by the tensioning means 135 can also be achieved by gripping the feed portion or leg 197 of the tensioned strap loop at some location outwardly of the strapping machanism 57, after which operation of the tensioning means may be discontinued.

Reference is now made to FIGS. 14-16 which illustrate further embodiments of the present invention and in which like elements are denoted by the same reference characters.

Shown in FIG. 14 are those elements of a semi-automatic strapping machine which are necessary for understanding the present invention, including a support or framework 213, having a table 215 and a fixed guide 217, and a strapping mechanism 219. Article stops 221 and 223 are disposed laterally of a strap path, as hereafter described, and adjustable relative to each other to accommodate articles of different sizes.

The strapping mechanism 219 shown in FIG. 14 is supported on the guide 217 by bearings 225 and includes gripping means 227 and holding means 229 for fixing the respective leading end and feed portions of a strap S, means 231 for sealing overlying strap portions, and strap feed and tensioning means 233 which includes wheels 235 and 237. When using a strap S formed of thermoplastic material, all such means 227, 229, 231, and 233 may be of a construction and operate in a manner as described in the cited Goodley patent. A rack 239 is fixed to the strapping mechanism 219 and is engaged by a pinion 241 which is driven by a motor, not shown. Movement of the strapping mechanism 219 to the left, as viewed in FIG. 14, is limited by a stop 243.

In the use of this embodiment, a predetermined length of strap S is fed from a supply, not shown, by the feed means 233 so that its leading end portion 244 is accessible for gripping and manual lacing as a loop about the article A. As in conventional semi-automatic strapping machines, insertion of the leading end portion 244 into the gripping means 227 actuates a switch, not shown, which initiates a sequence of operations. More particularly, in such sequence of operations, the gripping means 227 is first caused to engage and fix the leading end portion of the strap S, after which the tensioning means 233 is operated to apply the strap S onto the article A as a tensioned loop. As thus far described, the apparatus shown in FIG. 14 functions in the same manner as conventional strapping machines. However, with the apparatus of this invention, after the tensioned strap loop is applied to the article A, the operation of the tensioning means 233 is continued so as to at least maintain the tension in the strap loop while movement is imparted to the strapping mechanism 219 in the direction indicated by arrow 245 by the rack 239 and 241.

Thus, with this embodiment, the tension developed on the leading end portion of the strap loop by the pulling force imposed thereon may be less than and approach or equal that which is provided by the pulling force imposed on the feed portion of such loop.

The embodiment of the apparatus shown in FIG. 15 differs from that illustrated in FIG. 14 only by having the strap feed and tensioning means 233 positioned separate from the strapping mechanism 219. With this arrangement, movement of the strapping mechanism 219 in the direction of the arrow 245 is achieved by driving the rack 239 by the pinion 241, with a pulling force imposed on the leading end portion of the strap which is less than or equal to that imposed by the means 233 and, if the feed portion of the strap does not slip relative to such means 233, the pulling force imposed on the leading end portion of the strap may exceed that imposed on the feed portion thereof.

In the embodiment of the apparatus shown in FIG. 16, a sub-frame 247 is fixed to the underside of the table 215 and carries the guide 217 and strap feed and tensioning means 233. As thus far described, the apparatus shown in FIGS. 15 and 16 are essentially the same. In the latter apparatus, however, an auxiliary gripping or holding means 251, which is not part of the strapping mechanism 219, is fixed to the table 215.

In the operation of this embodiment, the strap S laced about the article A and held by the gripping means 227 is tensioned onto the article A by the tensioning means 233, after which the feed portion of the strap is fixed by the holding means 251. Such operation is similar with that of certain known strapping machines. However, with the embodiment shown in FIG. 16, prior to sealing of overlying strap portions, the strapping mechanism 219 is urged by the rack 239 and pinion 241 in the direction of arrow 245 to impose a pulling force on the leading end of the strap loop to thereby further tension the same. In this instance, the pulling force imposed on the leading end position of the strap may be less than, or equal to, or greater than that imposed on the feed portion of the strap. Once such tensioning is completed, the gripping means 229 is operated to hold the feed portion of the strap, after which the gripping means 251 is released and the overlying strap portions of the applied loop are sealed together.

We claim:

1. An article strapping apparatus including a support, means for feeding a strap having leading end and feed portions for lacing as a loop about an article which is to be strapped, a mechanism mounted for movement relative to said support, said mechanism including means for gripping the leading end portion of a strap looped about an article, tensioning means for engaging with and imposing a pulling force on a feed portion of a strap looped about an article, means for moving said mechanism relative to said support between retracted and projected positions to impose a pulling force on the leading end portion of a strap gripped by said gripping means whereby a strap looped about an article is tensioned about the article by the pulling forces imposed by said mechanism and tensioning means, and means for sealing overlying leading end and feed portions of a strap to maintain a tensioned strap loop in its tensioned condition about an article.

2. Apparatus as defined in claim 1 wherein said mechanism is mounted for movement in a plane relative to said support, and wherein said feeding means feeds a strap for lacing as a loop disposed substantially in said plane.

3. Apparatus as defined in claim 2 wherein said mechanism is mounted for movement horizontally in said plane relative to said support.

4. Apparatus as defined in claim 2 further including strap guide means disposed substantially in said plane and communicating with said strap feeding means and said mechanism for lacing a strap as a loop about an article which is to be strapped.

5. Apparatus as defined in claim 4 wherein said mechanism is mounted for movement horizontally in said plane relative to said support and said strap guide means.

6. Apparatus as defined in claim 5 wherein said support includes a fixed structure and a carriage, and wherein said mechanism is mounted on said carriage for movement horizontally in said plane relative thereto, and further including means for moving said carriage in said plane relative to said fixed structure between a retracted position in which said mechanism communicates with said strap guide means and a projected position in which said mechanism is disposed immediately adjacent to an article which is to be strapped, and means providing for movement of said mechanism into its projected position at least after said carriage is moved into its projected position.

7. Apparatus as defined in claim 4 wherein said mechanism is mounted on said support for movement vertically in said plane relative to said support and said strap guide means.

8. Apparatus as defined in claim 7 wherein said support includes a fixed structure and a carriage, and wherein said mechanism is mounted on said carriage for movement vertically in said plane, and further including means for moving said carriage horizontally in said plane relative to said fixed structure between a retracted position in which said mechanism communicates with said strap guide means and a projected position in which said mechanism is disposed immediately adjacent to an article which is to be strapped, and means providing for projection of said mechanism at least after said carriage is moved into its projected position.

9. Apparatus as defined in claim 7 wherein said tensioning means is operative at least during the movement of said mechanism into its projected position, and further including means for holding the feed portion of a strap looped and tensioned about an article.

10. Apparatus as defined in claim 9 wherein said tensioning means is operative prior to and during the movement of said mechanism into its projected position.

11. Apparatus as defined in claim 10 wherein said tensioning means is movable with said mechanism and serves to initially tension a strap looped about an article and imposes a generally uniform pulling force on the feed portion of a strap while a pulling force is imposed on the leading end portion of a strap by movement of said mechanism into its projected position.

12. Apparatus as defined in claim 8 wherein said tensioning means is operative at least during the movement of said mechanism vertically into its projected position, and further including means for holding the feed portion of a strap looped and tensioned about an article.

13. Apparatus as defined in claim 12 wherein said tensioning means is operative prior to and during the movement of said mechanism vertically into its projected position.

14. Apparatus as defined in claim 13 wherein said tensioning means is movable vertically with said mechanism and serves to initially tension a strap loop about an article and to impose a generally uniform pulling force on the feed portion of a strap while a pulling force is imposed on the leading end portion of a strap by movement of said mechanism vertically into its projected position.

15. Apparatus as defined in claim 2 wherein said tensioning means is operative at least during the movement of said mechanism into its projected position, and further including means for holding the feed portion of a strap looped and tensioned about an article.

16. Apparatus as defined in claim 15 wherein said tensioning means is operative prior to and during the movement of said mechanism into its projected position.

17. Apparatus as defined in claim 16 wherein said tensioning means is movable with said mechanism and serves to initially tension a strap looped about an article and imposes a generally uniform pulling force on the feed portion of a strap while a pulling force is imposed on the leading end portion of a strap by movement of said mechanism into its projected position.

18. Apparatus as defined in claim 2 wherein said tensioning means is operative prior to the movement of said mechanism into its projected position, and further including means for holding the feed portion of a strap looped about an article and tensioned by the pulling force imposed by said tensioning means.

19. An article strapping apparatus including means for feeding a strap having leading end and feed portions from a supply for lacing as a loop about an article which is to be strapped, means for engaging with and moving the leading end and feed portions of a strap looped about an article to impose pulling forces of different magnitude on the respective strap portions to tension the strap loop about the article, and means for sealing overlying leading end and feed portions of the strap to maintain a tensioned strap loop in its tensioned condition about an article.

20. An apparatus as defined in claim 19 wherein said means for engaging and moving the leading end and feed portions of a strap are moved in sequence, whereby the pulling force imposed on one of the strap portions tensions a strap loop about an article and the pulling force imposed on the other of such strap portions increases the tension at least in such other portion.

21. An article strapping method which includes the steps of lacing a strap having leading end and feed portions as a loop disposed in a plane and extending about an article which is to be strapped, engaging and moving the lead end and feed portions of the strap to impose pulling forces which approach each other on the respective strap portions to tension the strap loop about the article, and thereafter sealing overlying leading end and feed portions of the strap to maintain the strap loop in its tensioned condition about the article.

22. A method as defined in claim 21 wherein the pulling forces are imposed at least in part in sequence with one of said leading end and feed portions being fixed at least while a pulling force is initially imposed on the other of said leading end and feed portions of the strap to tension said other strap portion and the strap loop about the article, and further including the step of at least maintaining the tension in said other strap portion while a pulling force is imposed on said one portion thereof.

23. An article strapping method which includes the steps of lacing a strap having leading end and feed portions as a loop disposed in a plane and extending about an article which is to be strapped, engaging and moving the leading end and feed portions of the strap at least partially in sequence to impose a pulling force on the respective ends thereof with one of said leading end and feed portions being fixed at least while a pulling force is initially imposed on the other of said leading end and feed portions of the strap to tension said other strap portion and the strap loop about the article, and further including the step of at least maintaining the tension in said other strap portion while a pulling force is imposed on said one portion thereof.

24. A method as defined in claim 23 wherein the leading end portion of the strap is fixed while a pulling force is first applied to the feed portion of the strap.

25. A method as defined in claim 24 wherein the pulling force imposed on the feed portion of the strap is at least maintained constant while a pulling force is imposed on the leading end portion of the strap.

26. A method as defined in claim 25 wherein the pulling force imposed on the leading end portion of the strap is less than the pulling force imposed on the feed portion thereof.

27. A method as defined in claim 26 wherein the pulling force imposed on the feed portion of the strap is increased while the pulling force is imposed on the leading end portion thereof.

28. A method as defined in claim 25 wherein the pulling force imposed on the leading end portion of the strap is greater than the pulling force imposed on the feed portion of the strap.

29. A method as defined in claim 28 wherein the pulling force on the feed portion is increased while a pulling force is imposed on the leading end portion of the strap.

30. A method as defined in claim 24 wherein the feed portion of the strap is fixed after the pulling force is imposed thereon, and wherein the pulling force imposed on the leading end portion of the strap is less than that imposed on the feed portion of the strap.

31. A method as defined in claim 24 wherein the feed portion of the strap is fixed after the pulling force is imposed thereon, and wherein the pulling force imposed on the leading end portion of the strap is greater than that imposed on the feed portion of the strap.

* * * * *

UNITED STATES PATENT AND TRADEMARK OFFICE

CERTIFICATE OF CORRECTION

PATENT NO. : 4,254,703

DATED : March 10, 1981

INVENTOR(S) : Edward W. Fulton and Philip J. Pistun

It is certified that error appears in the above-identified patent and that said Letters Patent are hereby corrected as shown below:

Column 13, line 19, delete the word "its".

Column 13, line 50, change "or" to --of--.

Column 14, line 29, change "faced" to --face--.

Column 15, line 45, after "and" insert --pinion--.

Column 16, line 16, change "position" to --portion--.

Signed and Sealed this

*Thirtieth* Day of *June 1981*

[SEAL]

*Attest:*

RENE D. TEGTMEYER

*Attesting Officer*

*Acting Commissioner of Patents and Trademarks*